US006644072B1

(12) United States Patent
Hsieh

(10) Patent No.: US 6,644,072 B1
(45) Date of Patent: Nov. 11, 2003

(54) REMOTE-CONTROLLED DOOR LOCK

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 0 days.

(21) Appl. No.: 10/184,912

(22) Filed: Jul. 1, 2002

(51) Int. Cl.[7] ..... E05B 59/00; E05B 49/00; E05B 47/00; E05B 47/06

(52) U.S. Cl. ..... 70/107; 70/257; 70/278.7; 70/279.1; 70/283

(58) Field of Search ..... 70/107, 279.1, 70/257, 278.7, 283, 277; 292/144

(56) References Cited

U.S. PATENT DOCUMENTS 2,765,648 A * 10/1956 Hatcher ..... 70/264
4,784,415 A * 11/1988 Malaval ..... 292/144
5,216,909 A * 6/1993 Armoogam ..... 70/278.7
5,588,318 A * 12/1996 Osborne ..... 70/469
5,943,888 A * 8/1999 Lawson ..... 70/278.7
6,462,431 B1 * 10/2002 Woo ..... 307/9.1

* cited by examiner

*Primary Examiner*—Lloyd A. Gall
*Assistant Examiner*—Michael J. Kyle

(57) ABSTRACT

A remote-controlled door lock includes a lock shell provided inside with a battery base, a circuit board, a deadbolt and two electromagnetic valves. The deadbolt has a through hole connected sidewise to a slide slot with a smaller breadth than the diameter of the through hole. The two electromagnetic valves are respectively positioned on and under the door bolt. The two electromagnetic valves are controlled to operate by a remote controller and actuate the deadbolt to move to a limited position. The deadbolt cannot be unlocked with a key only before it is released by a remote controller, thus obtaining the best effect of anti-theft.

2 Claims, 5 Drawing Sheets

REMOTE-CONTROLLED DOOR LOCK

BACKGROUND OF THE INVENTION

1. Field of the Invention

This invention relates to a remote-controlled door lock, particularly to one provided in a lock shell with two electromagnetic valves able to be controlled by a remote controller to operate relatively and actuate a deadbolt to move to a limited position, with a door lock impossible to be unlocked only by a key before it is relieved by a remote controller, thus achieving a best effect of anti-theft.

2. Description of the Prior Art

A conventional door lock, as shown in FIG. 1, includes a lock shell 10 installed with a lock base 11 inside. The lock base 11 is provided at one side with lock rods 110 able to extend out of the through hole 100 on the sidewall of the lock shell 10. The lock base 11 is further provided with a lock core 111 with a keyhole respectively at the inner and the outer side. Then, a pull plate 12 is fitted in the inner side surface of the lock shell 10, having a fixing plate 120 inserted in the slide hole 101 of the lock shell 10 and facing the fixing plate 102 of the lock shell 10. The lock shell 10 is further installed inside with a deadbolt 13 having one end inserted through the fixing plate 102 of the lock shell 10 and secured with the fixing plate 120 of the pull plate 12, with a spring fitted around one end of the door bolt 13 near the pull plate 12. The deadbolt 13 has the other end fixed with a stopper 131 able to extend out of the through hole 103 in the sidewall of the lock shell 10. Thus, when a key is inserted in the keyhole 112 of the lock core 111 and turned around to force the lock rods 110 and the stopper 131 to move inward toward the lock shell 10, the door lock can be unlocked.

However, a conventional door lock is to have its lock rods 110 locked only by a key so it can easily be pried unlocked with some unlocking tools, having bad effect of anti-theft.

SUMMARY OF THE INVENTION

The objective of the invention is to offer a remote-controlled door lock having good effect of anti-theft.

The feature of the invention is that a lock shell is installed inside with a battery base, a circuit board, a deadbolt and two electromagnetic valves. The deadbolt is bored with a through hole connected sidewise to a slide slot with a smaller breadth than the diameter of the through hole. The two electromagnetic valves are respectively positioned on and under the deadbolt, and the electromagnetic valve on the deadbolt is provided with a downward valve rod having a stopper on the end, with the valve rod and the stopper inserted through the through hole of the deadbolt, while the electromagnetic valve under the deadbolt is provided with a lateral valve rod having a blocking plate at the outer end for stopping and holding the stopper of the electromagnetic valve on the door bolt.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
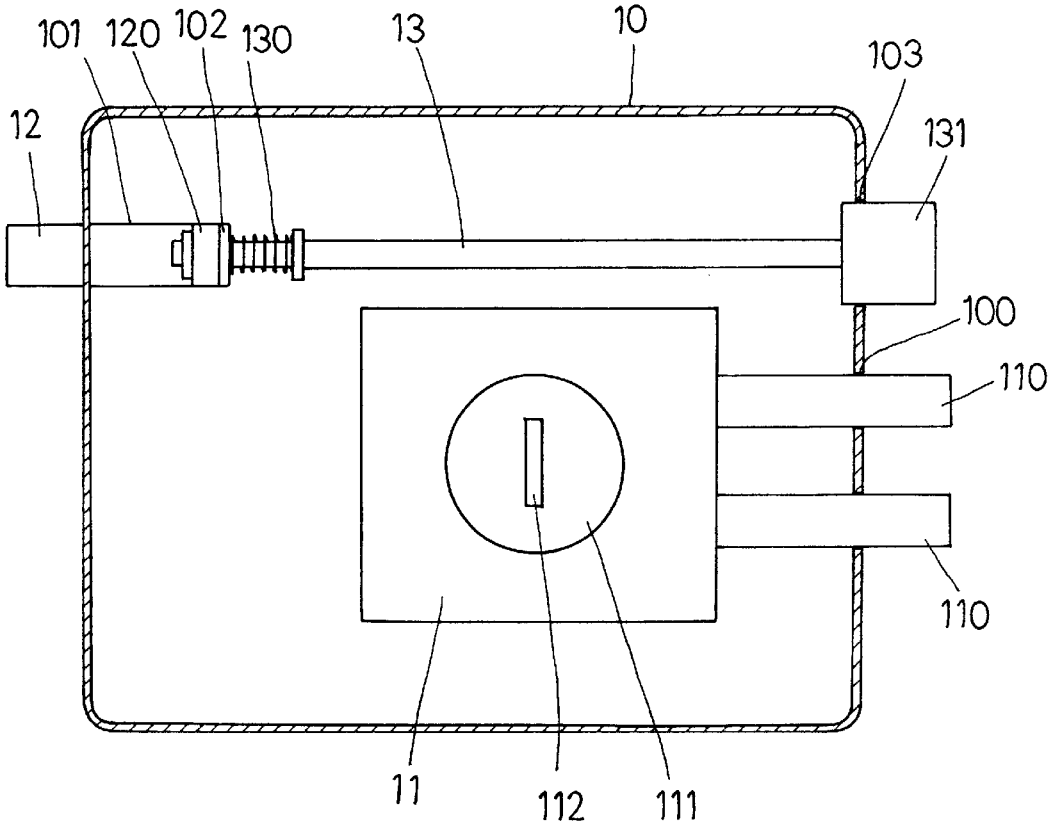
FIG.1 (PRIOR ART)
FIG. 1 is a cross-sectional view of a conventional door lock.
Figure 2:
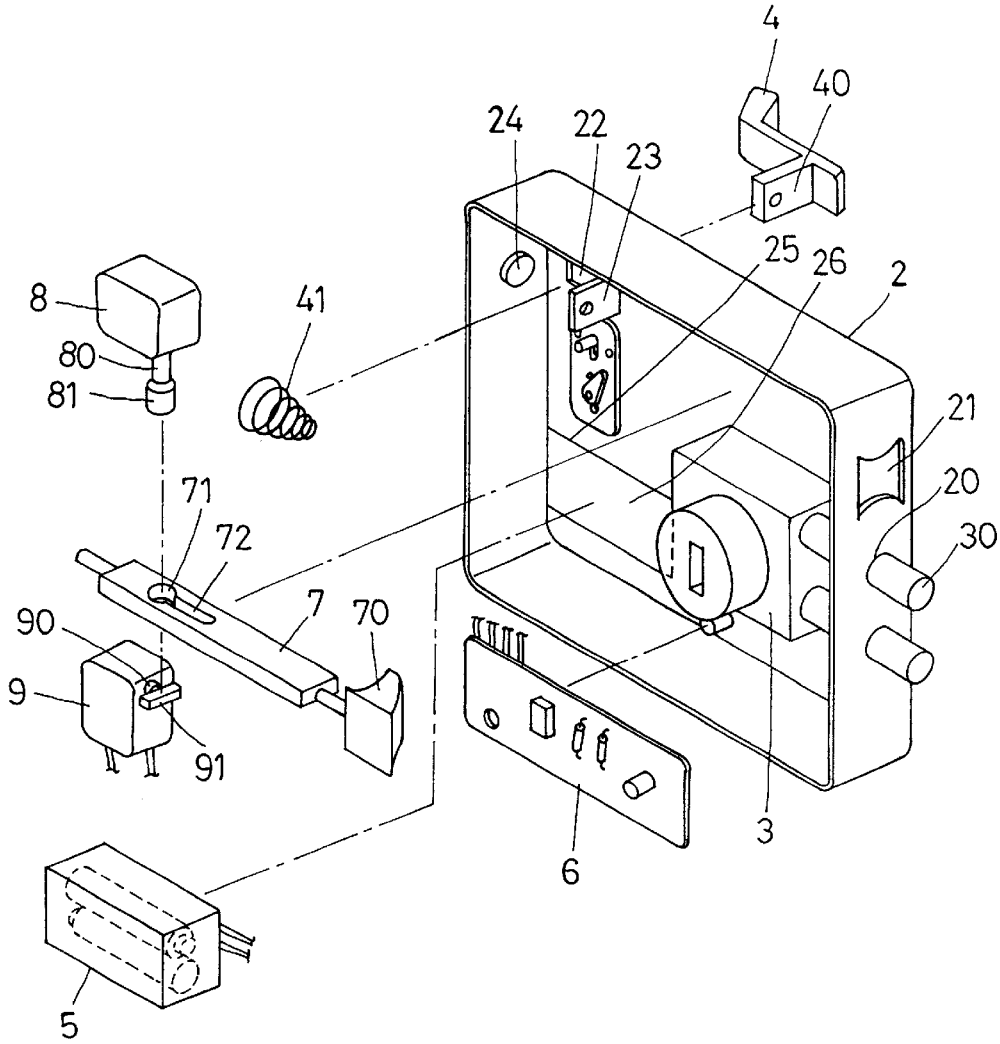
FIG. 2 is an exploded perspective view of a remote-controlled door lock in the present invention.
Figure 3:
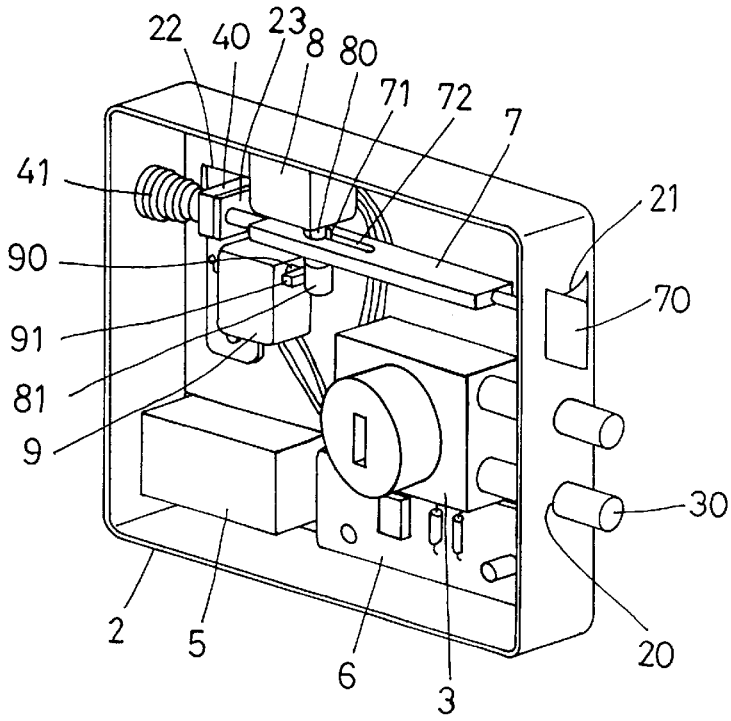
FIG. 3 is a perspective view of the remote-controlled door lock in the present invention.
Figure 4:
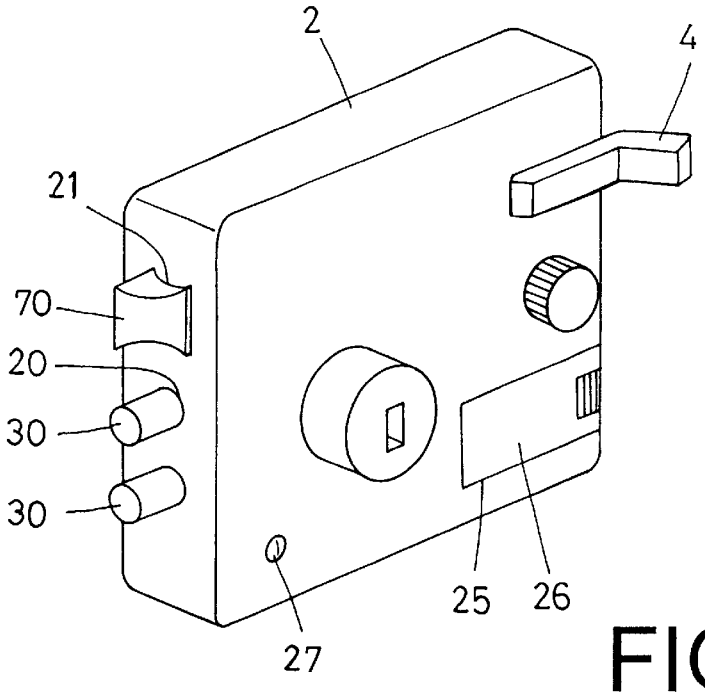
FIG. 4 is another perspective view of the remote-controlled door lock in the present invention.

A preferred embodiment of a remote-controlled door lock in the present invention, as shown in FIGS. 2, 3 and 4, includes a lock shell 2, a lock base 3, a pull plate 4, a battery base 5, a circuit board 6, a deadbolt 7, and two electromagnetic valves 8 and 9 as main components combined together.

The lock shell 2 has the lock base 3 installed in the interior, a slide hole 22 bored in a rear wall, a fixing plate 23 fixed at a side of the slide hole 22, a projection 24 fixed on an inner surface of a left side wall, an opening 25 bored in the rear wall and a cover plate 26 provided to close up the opening 2, and a warning lamp 27 fixed on an outer surface of the rear wall The lock base 3 is installed inside the lock shell 2 and provided with lock rods 30 able to extend out of the through holes 20 on the right side wall of the lock shell 2, with another through hole 21 bored on the right side wall of the lock shell 2 above the through holes 20.

The pull plate 4 is formed with a vertical connect plate 40 to be inserted in the slide hole 22 of the lock shell 2, with a spring 41 having one end fitted around the projection 24 in the lock shell 2 and the other end pushing against the connect plate 40 of the pull plate 4.

The battery base 5 and the circuit board 6 are installed inside the lock shell 2, the former located at the opening 25 of the lock shell 2 and closed up by a cover plate 26.

The deadbolt 7 is positioned horizontally inside the lock shell 2, having one end fixed with a block 70 extending in the through hole 21 of the lock shell 2 and the other end inserted through the fixing plate 23 of the lock shell 2 and fixedly combined with the connect plate 40 of the pull plate 4. Besides, the deadbolt 7 is bored with a through hole 71 connected sidewise to a slide slot 72 with a comparatively smaller breadth than the diameter of the through hole 71.

The two electromagnetic valves 8 and 9 are respectively provided on and under the deadbolt 7. The upper electromagnetic valve 8 has a valve rod 80 protruding downward and a stopper 81 at the lower end. The valve rod 80 together with the stopper 81 is inserted movably through the through hole 71 of the deadbolt 7. The lower electromagnetic valve 9 has on one side with a lateral valve rod 90 provided with a blocking plate 91 for stopping and supporting the stopper 81 of the upper electromagnetic valve 8.

Figure 5:
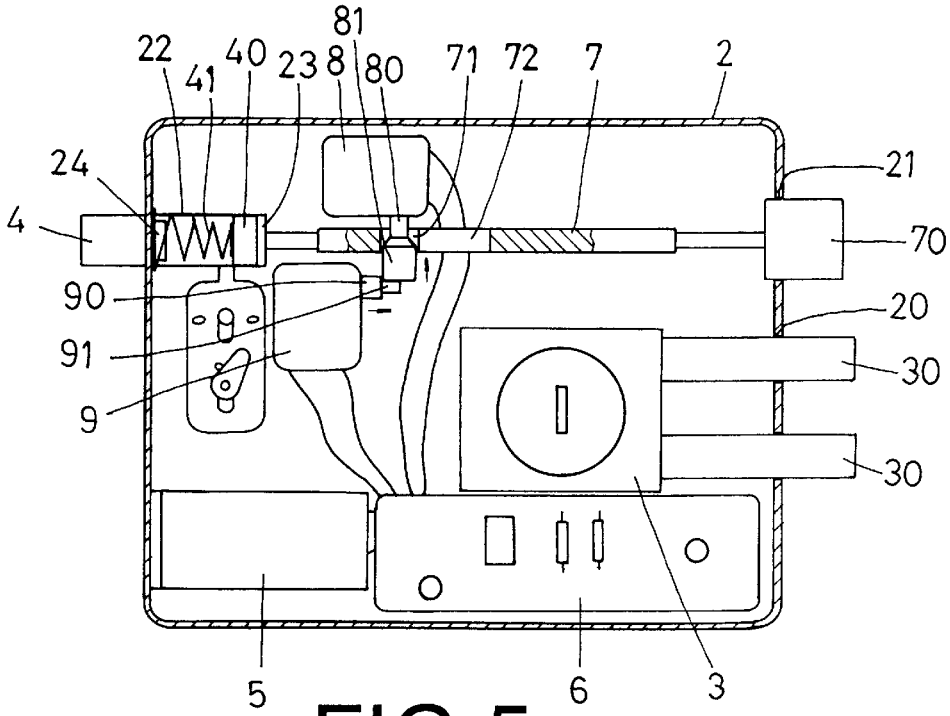
FIG. 5 is a cross-sectional view of the remote-controlled door lock locked by a remote controller in the present invention.
Figure 6:
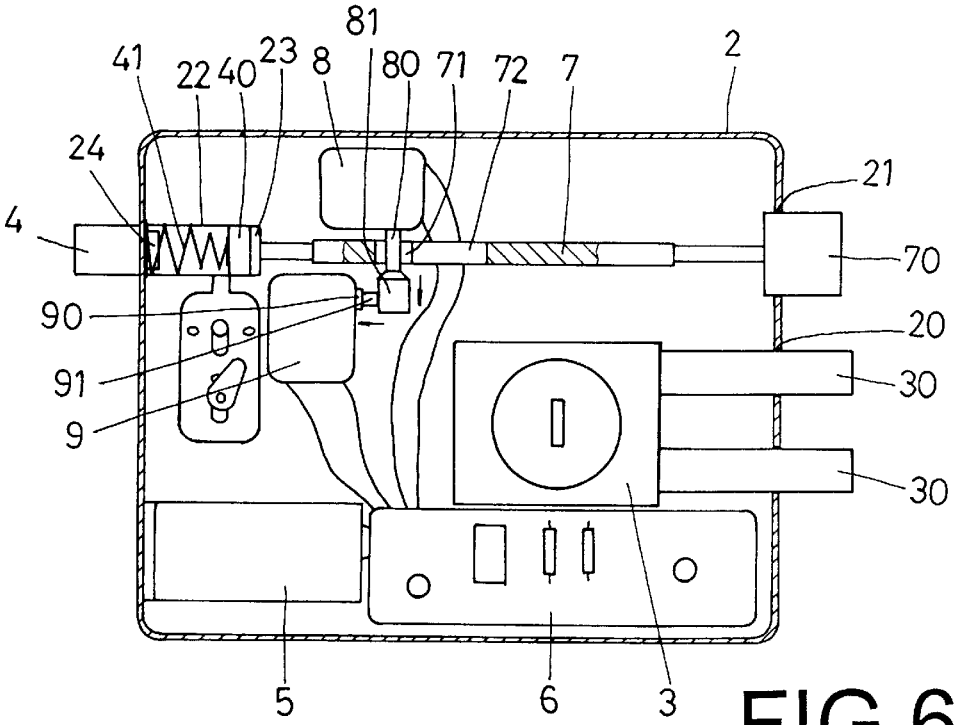
FIG. 6 is a cross-sectional view of the remote-controlled door lock in the process of being unlocked by a remote controller in the present invention; and, FIG. 7 is a cross-sectional view of the remote-controlled door lock unlocked in the present invention.
Figure 7:
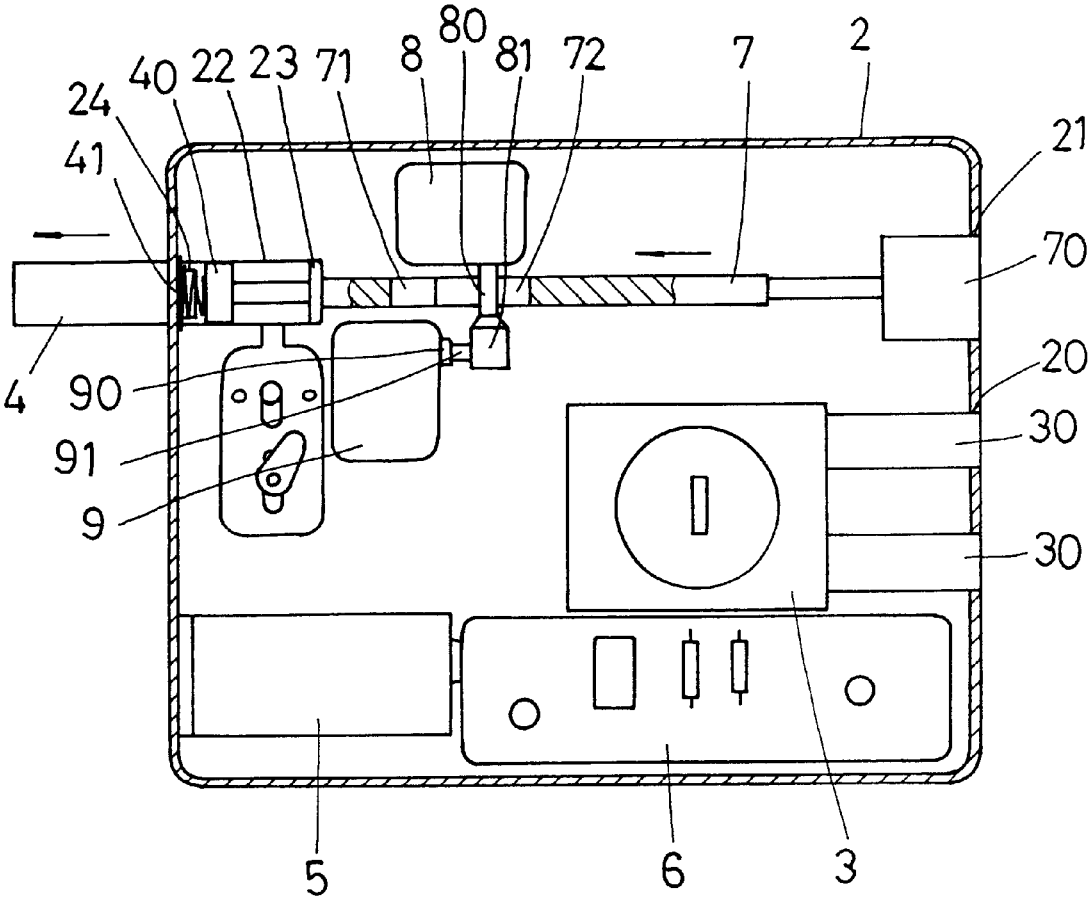

In using, as shown in FIGS. 5, 6 and 7, to lock the door lock, simply insert a key in the keyhole and turn it around to let the lock rods 30 of the lock base 3 extend outward and get into the lock hole in a door jamb. Then, press the locking button of a remote controller to let the two electromagnetic valves 8 and 9 operate. At this time, the upper electromagnetic valve 8 will begin exciting magnetism and its valve rod 80 will shrink upward and cut off electricity, while the lower electromagnetic valve 9 will also begin exciting magnetism and cutting off electricity to let its valve rod 90 protrude out.

Meanwhile, the stopper 81 of the upper electromagnetic valve 8 moves up together with the valve rod 80 to locate in the through hole 71 of the door bolt 7, having its bottom side stopped and held by the blocking plate 91 of the lower electromagnetic valve 9 to prevent the stopper 81 from moving down. Since the breadth of the slide slot 72 of the deadbolt 7 is smaller than the diameter of the stopper 81, the stopper 81 can stop the deadbolt 7 immovable, and as a consequence the block 70 of the deadbolt 7 cannot move inward. Thus the door lock is locked completely. In this case, even though the lock rods 30 of the lock base 3 are unlocked, the door lock still cannot be unlocked unless a remote controller is employed to release the deadbolt 7 first, thus acquiring the best effect of anti-theft.

On the contrary, to unlock the door lock, as shown in FIGS. 6 and 7, only press the unlocking button of the remote controller to let the two electromagnetic valves 8 and 9 operate. Then the electromagnetic valve 8 begins exciting magnetism and cuts off electricity, and its valve rod 80 will protrude downward, and when the electromagnetic valve 9 begins exciting magnetism, its valve rod 90 will shrink inward and cut off electricity. At this time, the blocking plate 91 of the lower electromagnetic valve 9 no longer stops or supports the bottom side of the stopper 81 of the upper electromagnetic valve 8, and therefore the stopper 81 will move downward together with the valve rod 80 and get away from the through hole 71 of the door bolt 7, while the valve rod 80 will still remain in the through hole 71. As the diameter of the valve rod 80 is smaller than the breadth of the slide slot 72 of the deadbolt 7, the valve rod 80 can slide in the slide slot 72, and hence the deadbolt 7 together with its block 70 can be moved inward. Then a key is inserted in the keyhole and turned around to let the lock rods 30 of the lock base 3 moved inward to get away from the lock hole of a door jamb, and then the door lock is easily unlocked.

In addition, when the electricity in the battery in the battery base 5 is used up, the two electromagnetic valves 8 and 9 will repeat the unlocking motion as described above to unlock the deadbolt 7, and the warning lamp 27 will give out light to remind a user to renew the battery, with a beeper available to take the place of the warning lamp 27.

The principle of controlling and actuating of the two electromagnetic valves 8 and 9 is applicable to the lock rods of various locks. When the lock rods are position-limited by the two electromagnetic valves 8 and 9, the lock cannot be unlocked by means of a key only before it is relieved with a remote controller, equally having the best effect of anti-theft.

While the preferred embodiment of the invention has been described above, it will be recognized and understood that various modifications may be made therein and the appended claims are intended to cover all such modifications that may fall within the spirit and scope of the invention.

What is claimed is:

1. A remote-controlled door lock comprising a lock shell, said lock shell provided with a lock base in the interior and a through hole bored in a right side wall and a slide hole bored in an upper portion of a rear wall, said slide hole provided inside with a fixing plate, said lock shell further having a projection on an inner surface of a left side wall, a pull plate provided to have a vertical connect plate, said vertical connect plate of said pull plate inserted in said slide hole of said lock shell, a spring having one end fitted around said projection of said lock shell and the other end pushing against said connect plate of said pull plate, a deadbolt installed horizontally in the interior of said lock shell, said deadbolt having one end fixed with a block, said block able to be inserted in said through hole of said lock shell, said deadbolt having the other end inserted through said fixing plate of said lock shell and fixedly combined with said connect plate of said pull plate; and, wherein a battery base and a circuit board installed in said lock shell, said deadbolt bored with a through hole, a slide slot connected sidewise to said through hole and having a smaller breadth than the diameter of said through hole, an upper electromagnetic valve on said deadbolt provided with a valve rod having a stopper at an end, said valve rod and said stopper inserted through said through hole of said deadbolt, a lower electromagnetic valve under said door bolt provided with a valve rod having a blocking plate at an outer end, said blocking plate stopping and supporting said stopper of said upper electromagnetic valve on said deadbolt, said upper and lower electromagnetic valves controlled by a remote controller to operate, said upper and lower electromagnetic valves allow the deadbolt to be actuated to move to a limited position by said pull plate when said upper and lower electromagnetic valves are in an unlock position said deadbolt impossible to be unlocked by a key only before it is released by a remote controller, having the best effect of anti-theft.

2. The remote-controlled door lock as claimed in claim 1, wherein a warning lamp is fixed on an outer surface of said lock shell for checking the electricity of the battery in said battery base.

* * * * *